US006474515B1

(12) United States Patent
Ladina et al.

(10) Patent No.: US 6,474,515 B1
(45) Date of Patent: Nov. 5, 2002

(54) VENTED CLOSURE

(75) Inventors: Joseph M. Ladina, Marietta, GA (US); Thomas C. Stoneberg, Buffalo Grove; Gary L. Berge, Crystal Lake, both of IL (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/709,245

(22) Filed: Nov. 10, 2000

(51) Int. Cl.[7] ..... B67D 3/00
(52) U.S. Cl. ..... 222/481.5; 222/483; 222/521
(58) Field of Search ..... 222/481.5, 483, 222/484, 525, 521

(56) References Cited

U.S. PATENT DOCUMENTS

| | | | | | |
|---|---|---|---|---|---|
| D278,311 | S | | 4/1985 | Brown et al. | D9/436 |
| 4,625,899 | A | * | 12/1986 | Stull | 222/521 |
| 4,773,572 | A | * | 9/1988 | Stull | 222/521 |
| 4,967,941 | A | | 11/1990 | Beck | 222/521 |
| 5,305,932 | A | | 4/1994 | Iseli | 222/521 |
| 5,328,063 | A | * | 7/1994 | Beck et al. | 222/525 |
| 5,358,152 | A | * | 10/1994 | Banks | 222/521 |
| 5,431,305 | A | | 7/1995 | Kaminski | 222/109 |
| D381,907 | S | | 8/1997 | King | D9/443 |
| D381,910 | S | | 8/1997 | Sayers et al. | D9/447 |
| 5,687,863 | A | | 11/1997 | Kusz | 215/216 |
| 5,829,611 | A | | 11/1998 | Beck | 215/252 |
| D423,358 | S | | 4/2000 | Kreiseder | D9/449 |
| D424,442 | S | | 5/2000 | Kreiseder | D9/449 |
| 6,079,589 | A | * | 6/2000 | Matsuyama et al. | 222/525 |
| 6,135,329 | A | | 10/2000 | Stoneberg et al. | 222/521 |
| 6,170,720 | B1 | * | 1/2001 | Gnepper et al. | 222/481.5 |

FOREIGN PATENT DOCUMENTS

| | | |
|---|---|---|
| CH | 645 07 | 9/1984 |
| GB | 426 726 | 4/1935 |

OTHER PUBLICATIONS

Blue Print Drawing entitled "Long Skirt" Closure dated Nov. 19, 1999.
Blue Print Drawing entitled "28mm TE closure Over–all Dims." dated Jan. 29, 1999.
Blue Print Drawing entitled "28mm Universal Twist" dated Apr. 27, 1999.
Blue Print Drawing entitled "30–25 Universal Twist" dated Apr. 27, 1999.

* cited by examiner

*Primary Examiner*—Philippe Derakshani
(74) *Attorney, Agent, or Firm*—Sutherland Asbill & Brennan LLP

(57) ABSTRACT

A closure for a bottle. The closure includes a spout neck attached to the bottle and a cap rotatably positioned on the spout neck. The spout neck may have a sealing lip and the cap may have an internal vent and an internal body portion. The sealing lip of the spout neck and the body portion of the cap align to seal the bottle when the cap is in a first position. The sealing lip of the spout neck and the circular vent of the cap align so as to vent the bottle when the cap is turned to a second position.

33 Claims, 5 Drawing Sheets

VENTED CLOSURE

TECHNICAL FIELD

The present invention relates generally to a closure for a beverage bottle and more particularly relates to a closure that vents pressurized gases in a controlled manner while being opened.

BACKGROUND OF THE INVENTION

Non-carbonated beverages such as waters, teas, juices, sports drinks, and the like may be sold in single serving and multiple serving plastic and glass bottles. Plastic bottles, which are more commonly used, may be made out of a PET (Polyethylene Terephthalate) resin. The beverage bottle may be enclosed by a standard screw-off cap or a closure with a pull-up spout that the consumer can open and close with his or her fingers. This type of packaging allows the consumer to open and close the beverage bottle as desired.

Another known type of bottle closure has a twist-top spout. Instead of pulling the spout up as in the pull-up closures, the consumer simply twists the spout. Examples of known twist-top closures are found in U.S. Design Patent Nos. 424,442 and 423,358. These patents are incorporated herein by reference.

Certain types of non-carbonated beverage bottles may be pressurized by injecting liquid nitrogen prior to capping. The nitrogen serves to make the bottle itself somewhat stiff. This bottle stiffness assists in labeling efficiency and in vending machine performance. The target internal bottle pressure after capping may be in the range of about ten (10) to about twenty-five (25) psi. Known twist-top closures, however, generally are not designed to hold internal bottle pressures. For those closures that are intended or designed to be used with a pressurized bottle, one drawback with these closure designs is that there may be some spraying or squirting of the beverage contained in the bottle when the closure is first opened. This spraying or squirting of the beverage may be caused by the sudden release of the internal pressure when the closure is first opened.

Known bottle closures also may use an over-cap of some sort to protect the spout itself. The consumer, however, generally removes the over-cap before the consumer opens the spout. The over-cap therefore generally has not provided any protection from the spraying or squirting described above. Further, while certain known over-caps produced by the applicants herein may be re-attachable, such re-attachable over-caps either have not used a frangible line or the frangible line is not readily visible to the consumer once broken. As such, the re-attachable over-caps may not provide immediate visual evidence of tampering.

What is needed, therefore, is a twist-top, pull-up, or other type of closure for a beverage bottle that holds pressure and provides controlled venting of this pressure during the opening of the bottle so as to eliminate beverage spraying or squirting. The closure and its use should be reasonably inexpensive and should not interfere with existing bottling equipment and methods.

SUMMARY OF THE INVENTION

The present invention thus provides a closure for a bottle. The closure includes a spout neck attached to the bottle and a cap retractably positioned on the spout neck. The spout neck may have a sealing lip and the cap may have an internal vent and an internal body portion. The sealing lip of the spout neck and the body portion of the cap align to seal the bottle when the cap is in a first position. The sealing lip of the spout neck and the circular vent of the cap align so as to vent the bottle when the cap is moved to a second position.

Specific embodiments of the present invention include the spout neck and the cap being made from a substantially rigid thermoplastic. The spout neck may include an extended body portion extending adjacent to the sealing lip. The cap may include a circular rib positioned adjacent to the internal body portion such that the circular rib aligns with the extended body portion of the spout neck when the cap is in the first position and the second position and such that the circular rib aligns with the sealing lip of the spout neck when the cap is in a third position.

The circular vent may include a number of cut out areas and a number of gaps. The circular vent also may include a number of segmented grooves therein. The segmented grooves may include a series of bosses therein. The circular vent may have a predetermined diameter such that an air gap is created when the circular vent aligns with the sealing lip.

The sealing lip of the spout neck may include a spout aperture with a sealing cap positioned therein. The cap may include a top surface with a cap aperture therein. The top surface may include a circular wall surrounding the cap aperture. The circular wall and/or the spout neck may be sized such that the circular wall and the sealing cap of the spout neck align to seal the cap aperture when the cap is in the first position and when the cap is moved to the second position. Specifically, the circular wall and the sealing cap of the spout neck align to seal the cap aperture when the cap is moved to the second position and the sealing lip of the spout neck and the circular vent of the cap align so as to vent the bottle. The circular wall and the sealing cap of the spout neck may align to open the cap aperture when the cap is moved to a third position.

The spout neck may include a base that is removably attachable to the bottle. The spout neck may include a number of recesses positioned on the base such that the cap may be positioned within one of the number of recesses. The spout neck may include a channel positioned thereon while the internal body portion of the cap may include a threaded segment thereon such that the segment engages the channel of the spout neck for movement therein.

The closure may further include an over-cap positioned over the cap. The over-cap may include a flexible thermoplastic. The over-cap may include an internal surface with a raised over-cap rib. The cap may include an exterior surface with a raised cap rib such that the raised over-cap rib and the raised cap rib align to secure the over-cap on the cap. The spout may include an over-cap recess for positioning the over-cap therein. The over-cap may include a frangible line. The frangible line may be positioned below the raised spout rib but above the over-cap recess when the over-cap is positioned therein such that the raised spout rib and the raised cap rib may align to secure the over-cap on the spout while the frangible line is visible.

A further embodiment of the present invention provides for a twist-top closure for a bottle. The closure may include a spout neck mounted to the bottle and a twist cap rotatably positioned on the spout neck. The spout neck may have a sealing lip with an aperture therein. The aperture may have a seal cap positioned therein. The twist cap may have a top aperture surrounded by a circular wall. The seal cap of the spout neck and the circular wall of the twist cap may align to seal the bottle when the twist cap is closed and when the twist cap is moved to a first position. The seal cap of the spout neck and the circular wall of the twist cap also may align to open the bottle when the twist cap is moved to a second position.

A further embodiment of the present invention provides for a twist-top closure for a bottle. The closure may include a spout neck attached to the bottle and a twist cap rotatably positioned on the spout neck. The spout neck includes a sealing lip with a spout aperture. The spout aperture may have a seal cap positioned therein. The twist cap may include an internal vent, an internal body portion, and a top aperture. The seal cap of the spout neck and the top aperture of the twist cap and the sealing lip of the spout neck and the body portion of the twist cap may align to seal the bottle when the twist cap is in a first position. The sealing lip of the spout neck and the circular vent of the twist cap align so as to vent the bottle while the seal cap of the spout neck and the top aperture of the twist cap remain sealed when the twist top is turned to a second position. The sealing lip of the spout neck and the internal body portion of the twist cap align so as to seal the circular vent while the seal cap of the spout neck and the aperture of the twist cap open when the twist cap is turned to a third position.

The method of the present invention provides for venting the internal pressure of a bottle with a beverage therein. The bottle may have a twist-top closure with a spout neck and a twist cap. The spout neck and the twist cap may form an upper seal and a side seal. The method may include the steps of twisting the twist cap such that the side seal opens while the top seal remains closed, venting the internal pressure through the side seal, and twisting the twist cap further such that the side seal closes and the top seal opens to permit the beverage to flow out of the bottle.

Other objects, features, and advantages of the present invention will be apparent upon review of the following detailed description of the preferred embodiments of the present invention when taken in conjunction with the drawings and the appended claims.

DETAILED DESCRIPTION OF THE INVENTION

Figure 1:
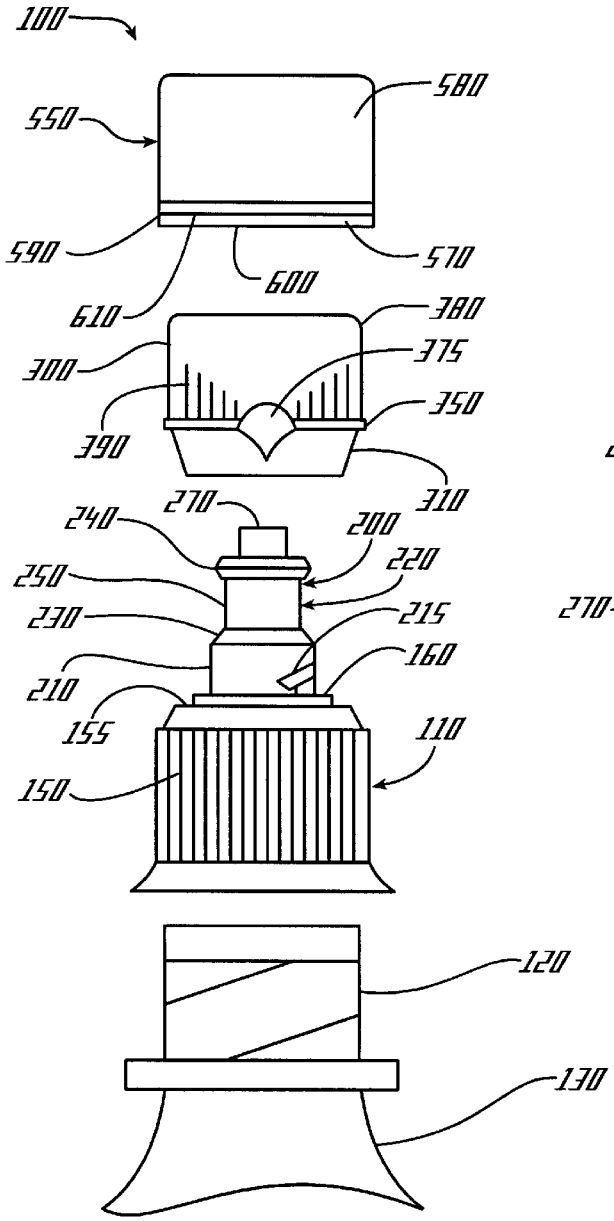
FIG. 1 is an exploded view of the closure of the present invention
Figure 2:
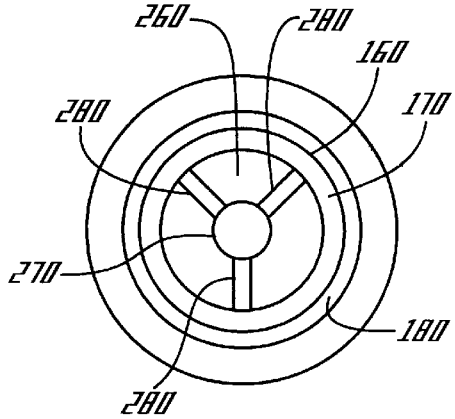
FIG. 2 is a top plan view of the spout neck and the base of the closure of FIG. 1.
Figure 3:
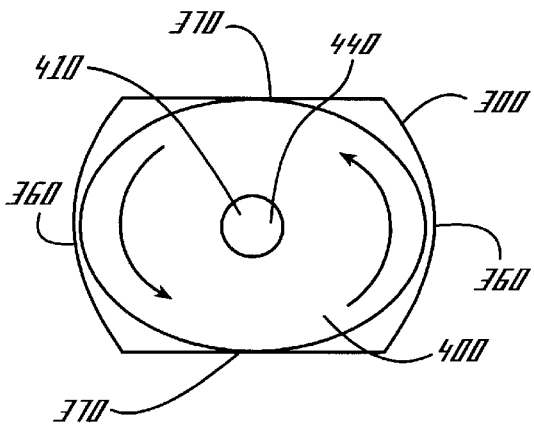
FIG. 3 is a top plan view of the twist cap of the closure of FIG. 1.
Figure 4:
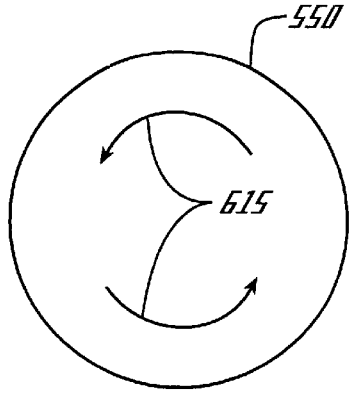
FIG. 4 is a top plan view of the over-cap of the closure of FIG. 1.
Figure 5:
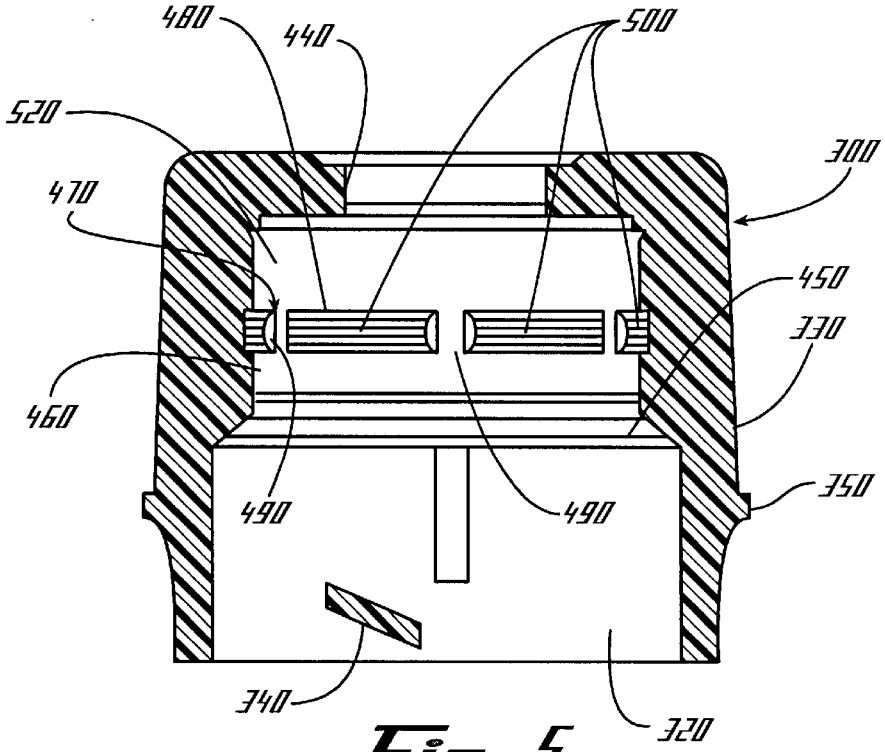
FIG. 5 is a side cross-sectional view of the twist cap of the closure of FIG. 1.

Referring now in more detail to the drawings, in which like numerals referred to like parts throughout the several views, FIGS. 1–5 show a bottle closure 100 of the present invention. The bottle closure 100 may be in the form of a twist-top closure as is described in more detail herein. The bottle closure 100 also may take the form of a pull-top closure or similar designs as are known to those skilled in the art. By way of example, U.S. Pat. No. 6,135,329 shows a closure base that may be used with a twist-top or a pull-top closure. U.S. Pat. No. 6,135,329 is incorporated herein by reference.

The closure 100 may include a base 110. The base 110 may be made from a substantially rigid thermoplastic such as polypropylene, polypropylene copolymers, high-density polyethylene, or similar types of materials. The base 110 may be made in an injection molding process or by similar manufacturing processes. The base 110 is sized to accommodate a conventional threaded neck 120 of a conventional beverage bottle 130. The bottle 130 may be made from PET or similar types of flexible thermoplastic materials. The base 110 may include internal threads 140 to mate with the threaded neck 120 of the beverage bottle 130. The base 110 also may include a ribbed portion 150 about its exterior so as to assist in removing the bottle closure 100 from the bottle 130 if desired. The dimensions of the closure 100 will depend upon the size of the bottle 130. For example, the base 110 may have a diameter of about 1.25 inches so as to accommodate a conventional 20 fluid ounce bottle 130.

Positioned on a top portion 155 of the base 110 may be an annular rib 160. The annular rib 160 may define two annular recesses, an over-cap recess 170 and a twist-top cap recess 180. The over-cap recess 170 is sized to accommodate an over-cap as explained in more detail below. Likewise, the twist-top cap recess 180 is sized to accommodate a twist-top cap or other type of cap as described in more detail below.

Positioned on the top portion 155 of the base 110 also may be a spout neck 200. The spout neck 200 may be integrally formed with the base 110 and may be made out of the same materials and through the same processes. The spout neck 200 may include a spout base 210 with one or more channels 215 formed therein. For use with the bottle 130 and the base 110 described above, the spout base 210 may be about 0.3 inches in length and about 0.6 inches in diameter. For use with a twist-top cap, the channel 215 may advance up the spout base 210 in a spiral fashion. The channel 215 may be similar to that disclosed in U.S. Pat. No. 4,967,941, incorporated herein by reference.

The spout neck 200 also may include a venting area 220 positioned on top of the threaded base 210. The venting area 220 may include a bottom flange 230 and a sealing lip 240. An extended neck portion 250 may separate the bottom flange 230 and the sealing lip 240. The bottom flange 230 may be about 0.05 inches in length and may have an upper diameter of about 0.5 inches. The sealing lip 240 may be about 0.1 inches in length and may have a maximum diameter of about 0.55 inches. The extended neck 250 portion may be a substantially smooth surface with a length of about 0.3 inches and a diameter of about 0.5 inches.

Positioned within the sealing lip 240 may be an aperture 260. The aperture 260 may have a diameter of about 0.5 inches. Positioned within the aperture 260 may be a sealing cap 270. The sealing cap 270 may be a raised circular structure. The sealing cap 270 may have a diameter of about 0.3 inches and a height of about 0.09 to 0.10 inches. The height of the sealing cap 270 is generally about 0.02 to about 0.03 inches longer than known devices produced by the applicants herein so as to accommodate the twist-top or other type of cap as described in more detail below, although other variations may be used. The sealing cap 270 may be attached to the spout neck 200 via a plurality of ribs 280 or by similar types of structures.

The bottle closure 100 also may include a twist-top cap 300. The twist-top cap 300 may be a separate element from the spout neck 200. The twist-top cap 300, however, may be made from the same materials and through the same processes as the spout neck 200, although high-density polyethylene is preferred. The twist-top cap 300 may be a substantially hollow structure. The twist-top cap 300 may include a base section 310. The base section 310 may have an interior surface 320 and an exterior surface 330. The base section 310 may have a wall thickness that is sized to fit and rotate within the twist-top cap recess 180 of the base 110. The interior surface 320 of the base section 310 may have a height of about 0.3 inches while the exterior surface 330 may have a height of about 0.2 inches.

The interior surface 320 of the base section 310 may have one or more thread segments 340 formed thereon. The thread segments 340 are designed to cooperate with the channel 215 of the spout base 210. Specifically, the thread segments 340 fit within the channel 215 so as to elevate the twist-top cap 300 when twisting in one direction and return the twist-top cap 300 to its starting position when twisting in the opposite direction.

Positioned above the exterior surface 330 of the base section 310 may be a raised spout rib 350. The raised spout rib 350 may be substantially oval in shape. The raised spout rib 350 may extend along the short ends or the perigees 360 of the twist-top cap 300. The raised spout rib 350 may be substantially eliminated along the long ends or the apogees 370 so as to form a smooth area 375 on both sides of the cap 300. These smooth areas 375 along the apogees 370 may assist the consumer grasping and turning the twist-top cap 300.

Positioned above the raised spout rib 350 on the twist-top cap 300 may be a cap body 380. Similar to the raised spout rib 350, the cap body 380 may be largely oval in shape. Positioned about the perigees 360 of the cap body 380 above the raised spout rib 350 may be a number of raised ribs 390. The raised ribs 390 also may assist the consumer in opening the twist-top cap 300. The area around the apogees 370 of the cap body 380 may be largely smooth and an extension of the smooth areas 375.

Positioned on the cap body 380 may be a cap top 400. The cap top 400 may be a substantially flat surface with an aperture 410 positioned therein. The aperture 410 may be sized to accommodate the sealing cap 270 of the spout neck 200. The aperture 410 may be largely circular in shape. The aperture 410 may define a circular wall 440. The circular wall 440 may have a length of about 0.06 to 0.10 inches so as to cooperate with the sealing cap 270 of the spout neck 200. It is understood that the length of the circular wall 440 and/or the length of the sealing cap 270 may be varied such that the two elements interact so as to form a seal of sufficient length as described in more detail below. The cap top 400 also may have arrow 405 or some other sort of indicia printed or formed thereon to indicate the twisting direction of the twist-top cap 300.

Positioned above the interior surface 320 of the base section 310 of the twist-top cap 300 may be a circular rib 450. The circular rib 450 may have a length of about 0.02 to about 0.05 inches. The circular rib 450 may have a diameter to accommodate the elements of the spout neck 200 in the sealing and the venting positions as described in more detail below. Specifically, the circular rib 450 may be positioned against the bottom flange 230 of the spout neck 200 in the closed position and then may rise up the extended neck 250 portion as the twist-top cap 300 is turned.

Positioned above the circular rib 450 may be a first circular band 460. The first circular band 460 may have a length of about 0.05 to about 0.06 inches and a diameter to accommodate the elements of the spout neck 200 in the sealing and the venting positions as described in more detail below. Specifically, the first circular band 460 largely corresponds to the position of the extended neck 250 of the spout neck 200 in the closed position and then may rise up the extended neck 250 portion and the sealing lip 240 as the twist top cap 300 is turned.

Positioned above the first circular band 460 may be a circular vent 470. The circular vent 470 may have a number of cut out areas 480 separated by a number of gaps 490. The cut out areas 480 may include a series of segmented grooves 500 therein. The segmented grooves 500 may be in the form of a series of bosses within the cut out area 480. The circular vent 470 may have a length of about 0.03 to about 0.04 inches and a diameter to accommodate the elements of the spout neck 200 in the sealing and the venting positions as described in more detail below. Specifically, the circular vent 470 may align substantially beneath the sealing lip 240 of the spout neck 200 when the twist-top cap 300 is in the closed position, with the sealing lip 240 as the twist-top cap 300 begins to turn, and above the sealing lip 240 when the twist-top cap 300 is fully turned. The cut out areas 480 may have a diameter of sufficient depth such that an air gap is created therebetween when the cut out areas 480 align with sealing lip 240.

Positioned above the circular vent 470 may be a second circular band 520. The second circular band 520 may have a length of about 0.07 to 0.08 inches and about the same diameter as the first circular band 460. The second circular band 520 may align substantially with the sealing lip 240 of the spout neck 200 when the twist-top cap 300 is in the closed position.

The bottle closure 100 also may include an over-cap 550. The over-cap 550 may be made from a flexible thermoplastic such as polypropylene, polypropylene copolymers, high density polyethylene, The over-cap 550 may be made in an injection molding process. The over-cap 550 is designed to fit within the over-cap recess 170 of the base 110.

Figure 13:
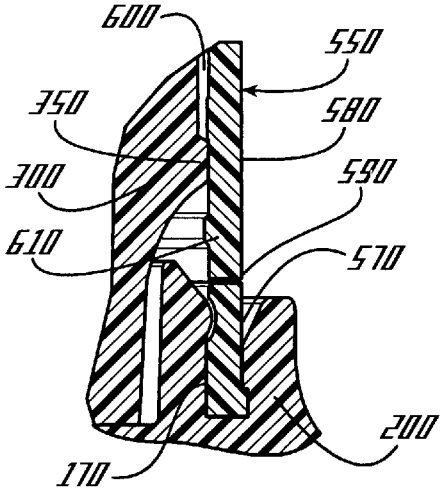
FIG. 13 is a partial side cross-sectional view of the over-cap positioned on the spout base.
Figure 14:
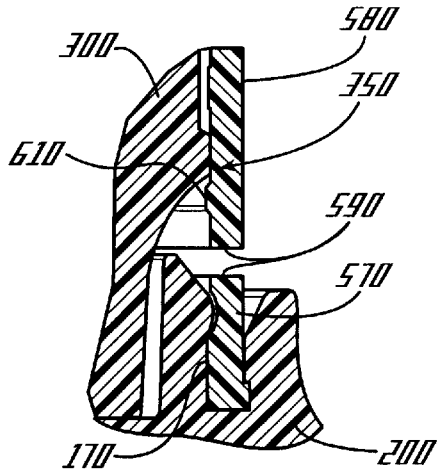
FIG. 14 is a partial side cross-sectional view of the over-cap being removed from the spout base.

As is shown in FIGS. 13–14, the over-cap 550 may have a circumferential projection 570 positioned within the over-cap recess 170 and a main body 580 extending out of the over-cap recess 170. Positioned slightly above the circumferential projection 570 may be a frangible line 590. The frangible line 590 permits the separation of the main body 580 of the over-cap 550 from the circumferential projection 570. The circumferential projection 570 may still be visible when the over-cap 550 has been removed. The design of the over-cap 550 may be similar to that described in U.S. Pat. No. 5,829,611, incorporated herein by reference.

The over-cap 550 also may have an interior surface 600. The interior surface 600 may have a raised rib 610 therein. The raised rib 610 may encircle the interior surface 600. The raised rib 610 is positioned such that it may catch the raised rib 350 of the twist-top cap 300 when the over-cap 550 is repositioned thereon. The over-cap 550 also may have an arrow 615 or some other type of indicia printed or formed thereon to indicate the twisting direction of the over-cap 550.

In use, the bottle closure 100 is positioned upon the neck 120 of the beverage bottle 130. As described above, the beverage bottle 120 may be slightly pressurized in the range of about ten (10) to twenty-five (25) psi. To open the bottle 130, the consumer first removes the over-cap 550. Removal of the over-cap 550 results in a break in the frangible line 590. Once the over-cap 550 is removed, the consumer may still be able to see the circumferential projection 570 as an indication that the over-cap 550 has been removed.

Figure 6:
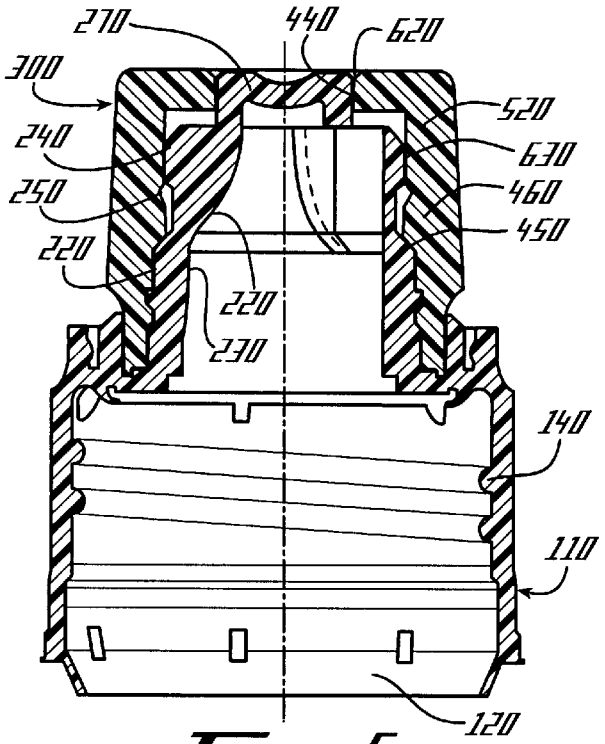
FIG. 6 is a side cross-sectional view of the closure of FIG. 1 in the sealed position.
Figure 7:
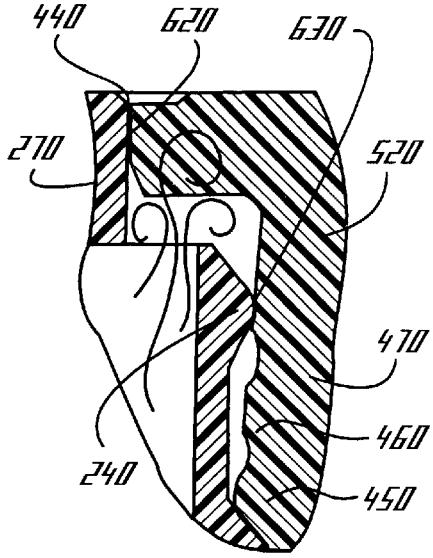
FIG. 7 is a partial side cross-sectional view of the closure of FIG. 1 in the sealed position with the gas stream shown.

The sealed position of the bottle 130 is shown in FIGS. 6 and 7. Any pressurized gases within the bottle 130 may be sealed within the bottle closure 100 at two primary seal points. A first seal point 620 may exist between the sealing cap 270 of the spout neck 200 and the circular wall 440 of the aperture 410 of the twist-top cap 300. The second seal point 630 may exist between the sealing lip 240 of the spout neck 200 and the second circular band 520 of the twist-top cap 300.

Figure 8:
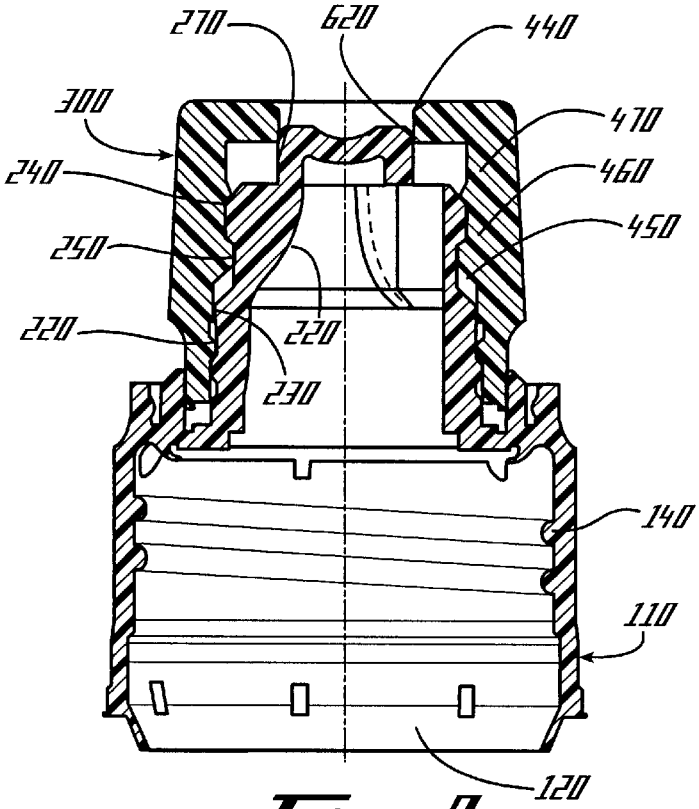
FIG. 8 is a side cross-sectional view of the closure of FIG. 1 in the venting position.
Figure 9:
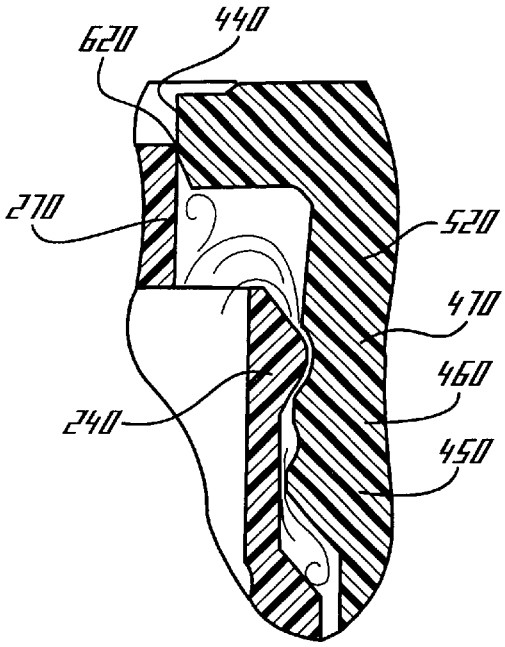
FIG. 9 is a partial side cross-sectional view of the closure of FIG. 1 in the venting position with the gas stream shown.
Figure 10:
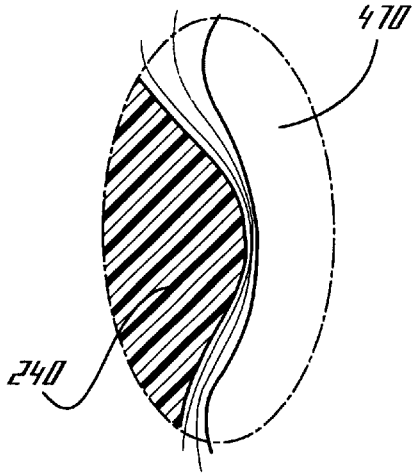
FIG. 10 is a partial side cross-sectional view of the closure of FIG. 1 in the venting position with the gas stream shown.

The consumer may then twist the twist-top cap 300. As the twist-top cap 300 is rotated and rises up the spout neck 200, the circular vent 470 moves into alignment with the sealing lip 240 of the spout neck 200. This orientation opens the second seal 630 and allows pressurized gases to pass through the cut out areas 480 or the segmented grooves 500 of the circular vent 570. FIGS. 8–10 show the bottle closure 100 in the venting position. The majority of the gas pressure may escape through the circular vent 470. Although the gases may be vented through the circular vent 470, the first seal 620 about the aperture 410 of the twist top cap 300 is still closed with respect to the sealing cap 270 and the circular wall 440. The first seal remains closed due to the prolonged contact between the sealing cap 270 and the circular wall 440 due to the extended length of the sealing cap 270, the circular wall 440, and/or both. As such, pressure only vents via the side of the bottle closure 100.

Figure 11:
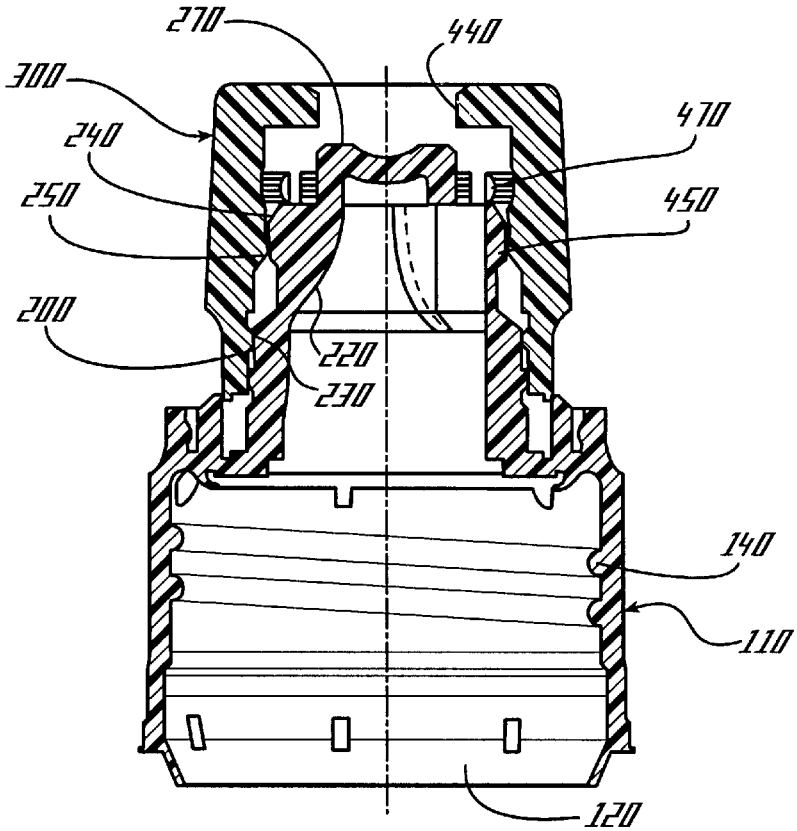
FIG. 11 is a side cross-sectional view of the closure of FIG. 1 in the dispensing position.
Figure 12:
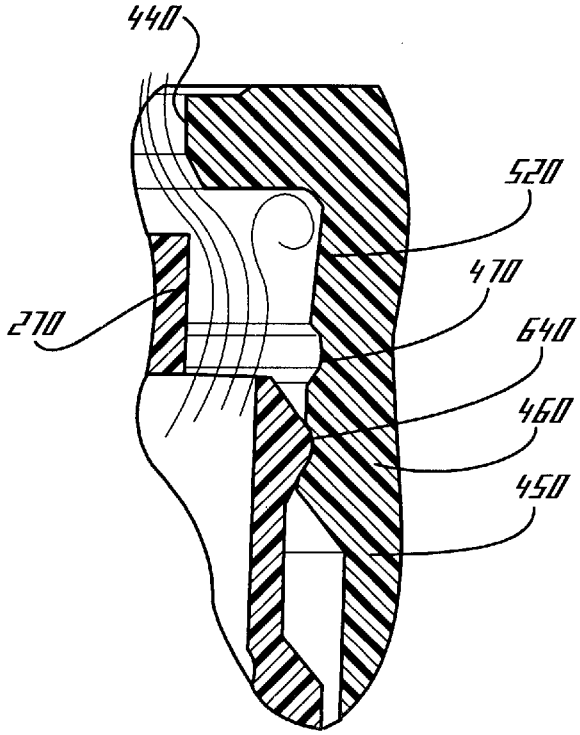
FIG. 12 is a partial side cross-sectional view of the closure of FIG. 1 in the dispensing position with the gas stream shown.

As the consumer continues to turn the twist-top cap 300, the circular rib 450 of the twist top cap 300 aligns with or below the sealing lip 240 of the spout neck 200. This alignment effectively closes the circular vent 470 and forms a third seal 640. As this point, the circular wall 440 about the aperture 410 of the twist-top cap 300 has cleared the sealing cap 270 of the spout neck 200 such that the first seal 620 is open. The beverage within the bottle 130 is now accessible via the bottle closure 100. The circular vent 470 is closed, however, so as to prevent liquid from leaking therethrough and along the sides of the closure 100. The consumer can thus enjoy the beverage within the bottle 130 via the closure 100. The dispensing position is shown in FIGS. 11 and 12.

Turning the twist-top cap 300 in the reverse direction may close the beverage bottle 100. The sealing cap 270 of the spout neck 200 effectively fills the aperture 410 of the twist-top cap 300 so as to reform a substantially liquid tight seal. The bottle closure 100 also may form an airtight seal, but such may not be necessary once the initial pressure within the bottle 130 has been released.

The over-cap 550 also may be placed back onto the spout neck 200. In doing so, the raised rib 610 of the over-cap 550 may catch on the raised rib 350 of the twist-top cap 300 so as to secure the over-cap 550 thereon. The over-cap 550 can be removed and replaced multiple times. Although the over-cap 550 may be removed multiple times, it is still apparent that the frangible line 590 has been broken. The use of the over-cap 550 thus provides for easy access to the beverage and also provides sanitary access. The use of the over-cap 550 in this manner also acts as a further means for preventing the spraying of the liquid therein.

It should be apparent that the foregoing relates only to the preferred embodiments of the present invention that numerous changes and modifications may be made herein without departing from the spirit and scope of the invention as defined by the following claims.

We claim:

1. A closure for a bottle, comprising:

a spout neck attached to said bottle;

said spout neck comprising a sealing lip; and a cap positioned for movement on said spout neck;

said cap comprising an internal vent and an internal body portion such that said sealing lip of said spout neck and said body portion of said cap align to seal said bottle when said cap is in a first position and such that said sealing lip of said spout neck and said internal vent of said cap align so as to vent said bottle when said cap is moved to a second position.

2. The closure for a bottle of claim 1, wherein said cap comprises a twist cap rotatably positioned on said spout neck.

3. The closure for a bottle of claim 1, wherein said spout neck and said cap comprise a substantially rigid thermoplastic.

4. The closure for a bottle of claim 1, wherein said spout neck comprises a base such that said base is removably attachable to said bottle.

5. The closure for a bottle of claim 4, wherein said spout neck comprises a plurality of recesses positioned on said base such that said cap may be positioned within one of said plurality of recesses.

6. The closure for a bottle of claim 1, wherein said spout neck comprises a channel positioned thereon.

7. The closure for a bottle of claim 6, wherein said internal body portion of said cap comprises a threaded segment thereon such that said segment engages said channel of said spout neck for movement therein.

8. The closure for a bottle of claim 1, wherein said spout neck comprises an extended body portion extending adjacent to said sealing lip.

9. The closure for a bottle of claim 8, wherein said cap comprises a circular rib positioned adjacent to said internal body portion such that said circular rib aligns with said extended body portion of said spout neck when said cap is in said first position and said second position and such that said circular rib aligns with said sealing lip of said spout neck when said cap is in a third position.

10. The closure for a bottle of claim 1, wherein said internal vent comprises a predetermined diameter such that an air gap is created therebetween when said vent aligns with said sealing lip.

11. The closure for a bottle of claim 1, wherein said internal vent comprises a plurality of cut out areas therein.

12. The closure for a bottle of claim 11, wherein said internal vent comprises a plurality of gaps positioned among said plurality of cut out areas.

13. The closure for a bottle of claim 12, wherein said internal vent comprises a plurality of segmented grooves therein.

14. The closure for a bottle of claim 13, wherein said plurality of segmented grooves comprises a plurality of bosses therein.

15. The closure for a bottle of claim 1, wherein said sealing lip of said spout neck comprises a spout aperture therein.

16. The closure for a bottle of claim 15, wherein said spout aperture comprises a sealing cap positioned therein.

17. The closure for a bottle of claim 16, wherein said cap comprises a top surface and wherein said top surface comprises a cap aperture therein.

18. The closure for a bottle of claim 17, wherein said cap aperture comprises a circular wall and wherein said circular wall is sized such that said circular wall and said sealing cap of said spout neck align to seal said cap aperture when said cap is in said first position and when said twist cap is moved to said second position.

19. The closure for a bottle of claim 17, wherein said cap aperture comprises a circular wall and wherein said sealing cap is sized such that said circular wall and said sealing cap of said spout neck align to seal said cap aperture when said cap is in said first position and when said twist cap is moved to said second position.

20. The closure for a bottle of claim 17, wherein said cap aperture comprises a circular wall and wherein said circular wall and said sealing cap are sized such that said circular wall and said sealing cap of said spout neck align to seal said cap aperture when said cap is moved to said second position and said sealing lip of said spout neck and said circular vent of said cap align so as to vent said bottle.

21. The closure for a bottle of claim 20, wherein said circular wall and said sealing cap of said spout neck align to open said cap aperture when said cap is moved to a third position.

22. The closure for a bottle of claim 1, further comprising an over-cap positioned over said cap.

23. The closure for a bottle of claim 22, wherein said over-cap comprises a flexible thermoplastic.

24. The closure for a bottle of claim 23, wherein said over-cap comprises an internal surface and wherein said interior surface comprises a raised over-cap rib.

25. The closure for a bottle of claim 24, wherein said cap comprises an exterior surface and wherein said exterior surface comprises a raised cap rib such that said raised over-cap rib and said raised cap rib align to secure said over-cap on said cap.

26. A twist-top closure for a bottle, comprising:

a spout neck mounted to said bottle;

said spout neck comprising a sealing lip;

said sealing lip comprising an aperture therein;

said aperture comprising a seal cap positioned therein; and a twist cap rotatably positioned on said spout neck;

said twist cap comprising a top aperture therein; and said twist cap comprising a circular wall surrounding said top aperture such that said seal cap of said spout neck and said circular wall of said twist cap align to seal said bottle when said twist cap is closed and when said twist cap is turned to a first position.

27. The twist-top closure for a bottle of claim 26, wherein said seal cap of said spout neck and said circular wall of said twist cap align to open said bottle when said twist cap is turned to a second position.

28. A twist-top closure for a bottle, comprising:

a spout neck attached to said bottle;

said spout neck comprising a sealing lip;

said sealing lip comprising a spout aperture;

said spout aperture comprising a seal cap positioned therein; and a twist cap rotatably positioned on said spout neck;

said twist cap comprising an internal vent and an internal body portion;

said twist cap comprising a top aperture positioned therein such that (1) said seal cap of said spout neck and said top aperture of said twist cap and (2) said sealing lip of said spout neck and said body portion of said twist cap align to seal said bottle when said twist cap is in a first position and such that said sealing lip of said spout neck and said internal vent of said twist cap align to vent said bottle while said seal cap of said spout neck and said top aperture of said twist cap remain sealed when said twist top is turned to a second position.

29. The twist-top closure for a bottle of claim 28, wherein said sealing lip of said spout neck and said internal body portion of said twist cap align to seal said internal vent while said seal cap of said spout neck and said aperture of said twist cap align to open when said twist cap is turned to a third position.

30. A closure for a bottle, comprising:

a spout;

said spout comprising a twist top cap;

said twist top cap comprising an exterior surface and wherein said exterior surface comprises a raised spout rib; and an over-cap positioned on said twist top cap;

said over-cap comprising an interior surface and wherein said interior surface comprises a raised cap rib such that said raised spout rib and said raised cap rib align to secure said over-cap on said twist top cap.

31. The closure for a bottle of claim 30, wherein said spout comprises an over-cap recess for positioning said over-cap therein.

32. The closure for a bottle of claim 31, wherein said over-cap comprises a frangible line, said frangible line positioned below said raised spout rib but above said over-cap recess when said over-cap is positioned therein such that said raised spout rib and said raised cap rib align to secure said over-cap on said spout while said frangible line is visible.

33. A method for venting an internal pressure of a bottle with a beverage therein, said bottle having a twist-top closure with a spout neck and a twist cap, said spout neck and said twist cap forming an upper seal and a side seal, said method comprising the steps of:

twisting said twist cap such that said side seal opens while said top seal remains closed;

venting said internal pressure through said side seal; and twisting said twist cap further such that said side seal closes and said top seal opens to permit said beverage to flow out of said bottle.

* * * * *

UNITED STATES PATENT AND TRADEMARK OFFICE

CERTIFICATE OF CORRECTION

PATENT NO. : 6,474,515 B1
DATED : November 5, 2002
INVENTOR(S) : Ladina et al.

It is certified that error appears in the above-identified patent and that said Letters Patent is hereby corrected as shown below:

Title page,
Item [73], please add the following assignee:
-- Courtesy Corporation, Buffalo Grove, Illinois (US) --

Signed and Sealed this

Tenth Day of June, 2003

JAMES E. ROGAN
*Director of the United States Patent and Trademark Office*